US010863832B2

(12) United States Patent
Malott

(10) Patent No.: US 10,863,832 B2
(45) Date of Patent: Dec. 15, 2020

(54) DISPOSABLE INFANT CO-SLEEPER

(71) Applicant: Tayla Malott, Fort McMurray (CA)

(72) Inventor: Tayla Malott, Fort McMurray (CA)

( * ) Notice: Subject to any disclaimer, the term of this patent is extended or adjusted under 35 U.S.C. 154(b) by 105 days.

(21) Appl. No.: 16/052,008

(22) Filed: Aug. 1, 2018

(65) Prior Publication Data

US 2020/0037782 A1 Feb. 6, 2020

(51) Int. Cl.

| | |
|---|---|
| ***A47D 9/00*** | (2006.01) |
| ***A47D 15/00*** | (2006.01) |
| ***A47C 29/00*** | (2006.01) |
| ***A47D 7/02*** | (2006.01) |
| ***A47D 7/00*** | (2006.01) |

(52) U.S. Cl.

CPC ..... *A47D 9/005* (2013.01); *A47C 29/006* (2013.01); *A47D 7/002* (2013.01); *A47D 7/02* (2013.01); *A47D 15/00* (2013.01)

(58) Field of Classification Search

CPC ..... A47D 9/00; A47D 9/005; A47D 15/00; A47D 7/002; A47D 7/005; A47D 7/02; A47D 7/04; A47D 13/06; A47D 13/061; A47D 13/063; A47D 13/066; A47C 29/00; A47C 29/006

See application file for complete search history.

(56) References Cited

U.S. PATENT DOCUMENTS 2,196,512 A * 4/1940 Williams ..... A47D 9/005 446/77
2,239,365 A * 4/1941 Loth ..... A63H 3/52 446/80
2,525,168 A * 10/1950 Dodge ..... A47D 9/005 5/98.2
2,748,928 A * 6/1956 Stavis ..... B65D 5/5073 206/560
3,336,608 A * 8/1967 Lerner ..... A47D 15/003 5/99.1
3,487,479 A * 1/1970 Grooms ..... A47D 13/02 5/93.1
3,774,357 A * 11/1973 Moore ..... E04H 1/12 52/36.2
4,250,580 A * 2/1981 Eichenauer ..... A47C 9/002 229/178
4,934,004 A * 6/1990 Friedman ..... A47D 7/002 5/118
5,099,988 A * 3/1992 Garran ..... B65D 81/368 206/223
5,115,524 A * 5/1992 Antosko ..... A47D 9/005 229/103

(Continued)

*Primary Examiner* — David R Hare
(74) *Attorney, Agent, or Firm* — David W Barman

(57) ABSTRACT

A disposable infant co-sleeper system including: a disposable infant co-sleeper assembly including a stand, and a sleeping cavity; wherein the disposable infant co-sleeper assembly includes in functional combination the stand and the sleeping cavity. The sleeping cavity is removably fastenable to the stand, such that the sleeping cavity is erected such that it is raised above and located on a plane above a planar surface at a height suitably matched to that of the parent sleeper. The sleeping cavity preferably is made of cardboard and has removable panels for ease of accessing an infant residing in the sleeping cavity. When the use is finished it can be disposed of in an environmentally efficient manner.

2 Claims, 5 Drawing Sheets

(56) References Cited

U.S. PATENT DOCUMENTS

| | | | | | |
|---|---|---|---|---|---|
| 5,172,435 | A * | 12/1992 | Griffin | A47D 7/04 | 5/312 |
| 5,473,785 | A * | 12/1995 | Lager | A47D 9/005 | 5/420 |
| 6,370,715 | B1 * | 4/2002 | Morton | A47D 7/002 | 5/655 |
| 6,877,173 | B2 * | 4/2005 | Tharalson | A47D 5/00 | 5/100 |
| 6,973,686 | B2 * | 12/2005 | Kenan | A47C 4/021 | 5/101 |
| 8,316,482 | B1 * | 11/2012 | Martin, III | A47C 29/00 | 5/655 |
| 9,756,963 | B2 * | 9/2017 | Bien-Willner | A47D 7/005 | |
| 2003/0177574 | A1 * | 9/2003 | Waldman | A47D 7/007 | 5/93.1 |
| 2011/0113549 | A1 * | 5/2011 | Riddiford | A47D 7/002 | 5/95 |
| 2018/0027990 | A1 * | 2/2018 | Kroeker | A47D 9/005 | |

* cited by examiner

DISPOSABLE INFANT CO-SLEEPER

BACKGROUND OF THE INVENTION

The following includes information that may be useful in understanding the present disclosure. It is not an admission that any of the information provided herein is prior art nor material to the presently described or claimed inventions, nor that any publication or document that is specifically or implicitly referenced is prior art.

TECHNICAL FIELD

The present invention relates generally to the field of beds and shelters of existing art and more specifically relates to a disposable infant co-sleeper.

RELATED ART

Many individuals in modern society sleep in beds. Beds are often kept in residential houses and apartments. When individuals get displaced from their homes during natural disasters or for other reasons, this may leave the displaced individuals with less than ideal conditions to sleep in such as shelters, camps or the like. Many times sufficient and proper beds are not available for infants and adults and people may have to share beds or sleep on the ground. In many cases the parent(s) may wish to co-sleep with their infant wherein the infant sleeps in their own bed directly adjacent the bed of the parent(s). Additionally, the location may be dirty or have pests that live on and move along the ground. Further insects such as mosquitos may pose a danger. This is not desirable, especially for infants. A suitable solution is desired wherein co-sleeping may be enabled.

U.S. Pub. No. 2011/0113,549 to Martin P. Riddiford et al., relates to cots for babies. The described cots for babies includes a cot is designed to be used positioned against the side of a parent bed. A folding leg arrangement enables the height of the cot sleeping base to be matched with the parent bed. The leg arrangement uses support struts and sliding connections to the cot support base to maintain its footprint at all heights. The end walls and side walls are all foldable relative to the sleeping base. The cot can be folded flat by folding the side walls onto the base and the end walls in on top of them. The leg arrangement can also fold flat. One side wall can be folded out to lie on the adjacent parent bed, bridging the gap. It can also be folded at half height to provide partial access when upright, or a shorter bridge when folded out.

SUMMARY OF THE INVENTION

In view of the foregoing disadvantages inherent in the known beds and shelters art, the present disclosure provides a novel disposable infant co-sleeper. The general purpose of the present disclosure, which will be described subsequently in greater detail, is to provide an efficient and effective disposable infant co-sleeper suitable to be height-matched with the parent bed.

A disposable infant co-sleeper system is disclosed herein. The disposable infant co-sleeper system comprises: a disposable infant co-sleeper assembly including a stand, and a sleeping cavity; wherein the disposable infant co-sleeper system comprises the disposable infant co-sleeper assembly, and the disposable infant co-sleeper assembly comprises in functional combination the stand and the sleeping cavity. The sleeping cavity may be removably fastenable to the stand in certain embodiments via hook and loop (VELCRO), adhesive, or other suitable means, such that the sleeping cavity is erected such that it is raised above and located on a plane above a planar surface. The sleeping cavity preferably comprises cardboard and has removable panels for ease of accessing an infant residing in the sleeping cavity. When the use is finished it can be disposed of in an efficient manner that doesn't leave a substantial environmental footprint. This disposal also prevents re-use by others that may cause disease to spread or the like.

According to another embodiment, a disposable infant co-sleeper system is also disclosed herein. The disposable infant co-sleeper system includes a method of use for the disposable infant co-sleeper system, the method comprising the steps of: providing a disposable infant co-sleeper assembly (as disclosed herein), removably coupling a sleeping cavity to a stand, and removing removable panels to access an infant residing in the sleeping cavity. The method may further comprise the step of: breast-feeding or otherwise consoling the infant at a comfortable height. Adjustment may be made to the legs such that the device is sturdy and stable during use.

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and methods of use for the present disclosure, a disposable infant co-sleeper, constructed and operative according to the teachings of the present disclosure.

The various embodiments of the present invention will hereinafter be described in conjunction with the appended drawings, wherein like designations denote like elements.

DETAILED DESCRIPTION

As discussed above, embodiments of the present disclosure relate to a bed and/or shelter and more particularly to a disposable infant co-sleeper as used to provide safe and secure means in which infants can sleep in during natural disasters and the like.

Generally, the stand of the present invention is erected and secured in place next to a parent cot or sleeping space. The cardboard baby cavity is placed securely into place on the stand. Parents have the option of punching out the side panels for extra closeness to their infant and to promote breastfeeding. There is an option of attaching a mosquito net covering to protect the baby from disease and infection. The plastic box mattress comes with a fitted sheet for comfort. Most disaster relief, evacuation and or refugee camp sleeping situations involve group sleeping spaces that consist of single person cots or floor sleeping. There are no safe sleeping options for infants which the present invention efficiently and effectively addresses. Having the baby sleeping cavity situated preferably 20 inches off the ground (more or less height may be used) keeps the baby at the same level as a parent cot, keeps baby off a potentially cold or wet ground and it also protects the infant from dangers such as pests, etc. It is important that the cavity remain safe as well as disposable. For the stand, the sides at the top are foldable into place, so the whole device can be stored (substantially) flat. The sides of the base may also be folded up into place. The height of the sides may be made to the same as the height of the lip left by tearing out the perforation on the side of the cavity. The stand is re-usable, but the cavity and mattress are disposable for safety reasons. Legs on the stand may have a crossbeam to help the stand remain stable during use and the stand legs may be locked. The mattress is of a thickness such that the baby will sleep on a firm surface and remain below the edge of the sleeping cavity while remaining accessible for co-sleeping.

The present invention is, includes and promotes:

- provides safe sleeping for infants
- is disposable for sanitary safety
- offers punch out sides to promote closeness and breastfeeding
- is readily collapsible for easy storage
- provides cost efficacy
- offers an optional mosquito net for protection
- has a stable stand that is rust proof and durable for multi-use
- the stand may comprise beveled legs to push into soft ground or rubberized ends to stand stable on hard flat ground.

Referring now more specifically to the drawings by numerals of reference, there is shown in FIGS. 1-4, various views of a disposable infant co-sleeper system 100.

Figure 1:
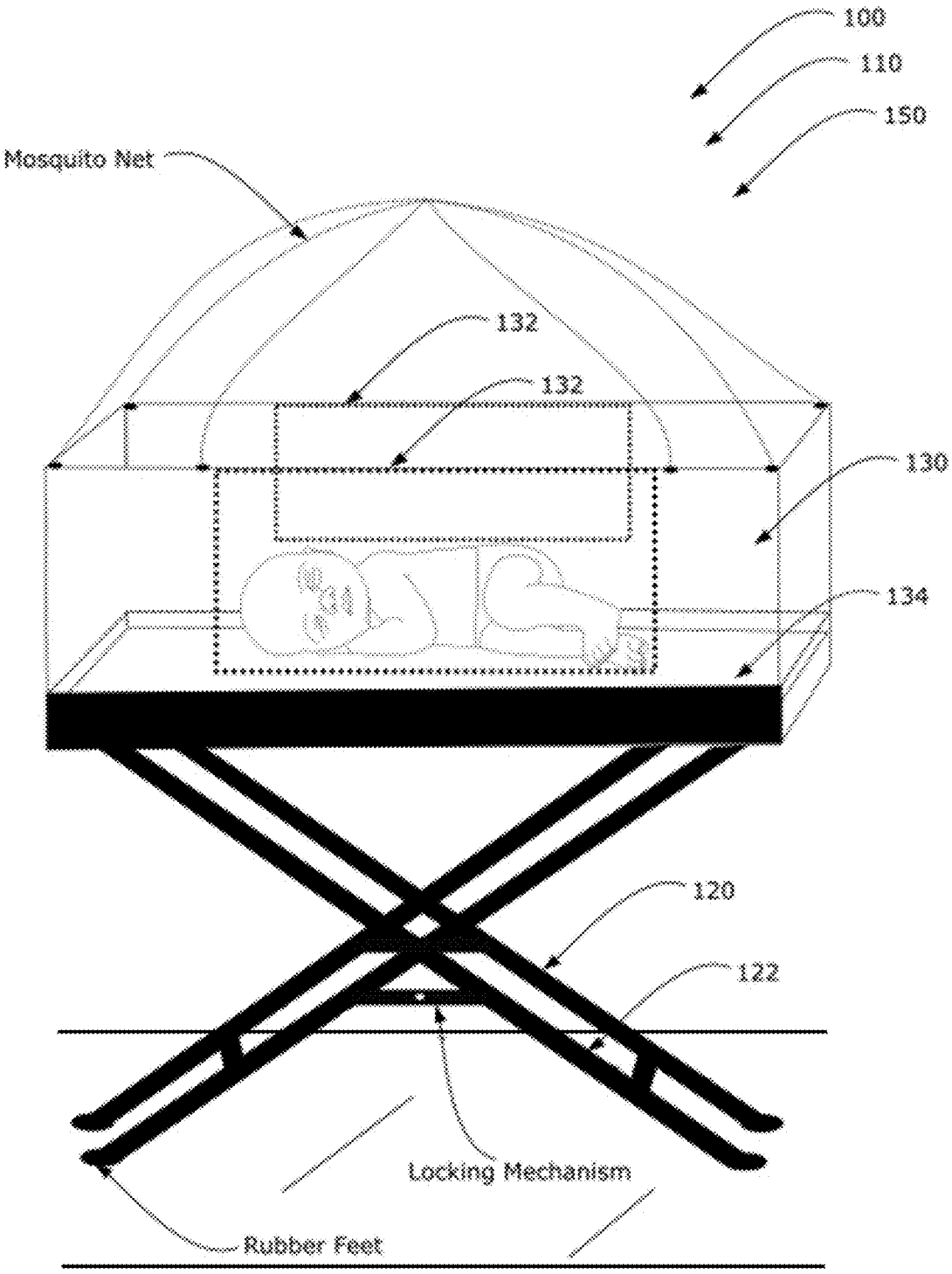
FIG. 1 is a perspective view of the disposable infant co-sleeper system during an 'in-use' condition, according to an embodiment of the disclosure.

FIG. 1 shows a disposable infant co-sleeper system 100 during an 'in-use' condition 150, according to an embodiment of the present disclosure. Here, the disposable infant co-sleeper system 100 may be beneficial for use by a user to allow safe and comfortable access to infants. As illustrated, the disposable infant co-sleeper system 100 may include a disposable infant co-sleeper assembly 110 including a stand 120, and a sleeping cavity 130; wherein the disposable infant co-sleeper system 100 comprises the disposable infant co-sleeper assembly 110. The disposable infant co-sleeper assembly 110 comprises in functional and structural combination the stand 120 and the sleeping cavity 130. The sleeping cavity 130 may be removably fastenable to the stand 120, or set in place on the stand 120 atop a permanent flat top with side extensions that fold up in place to create a base that the sleeping box (sleeping cavity 130) fits in. The height on those sides is equal to the lip left over when the side perforations (removable panels 132) are removed. such that the sleeping cavity 130 is erected such that it is raised above and located on a plane above a planar surface (such as a floor or ground surface). The sleeping cavity 130 comprises attaching means for attaching the sleeping cavity 130 to the stand 120. Those with ordinary skill in the art will now appreciate that upon reading this specification and by their understanding the art of fastening means as described herein, methods of fastening or otherwise temporarily securing via clips, detents, adhesives, hook and loop, buttons, snaps, and the like may be employed to achieve the desired results and will be understood by those knowledgeable in such art. In preferred embodiments the sleeping cavity 130 preferably comprises cardboard and has removable panels 132 for ease of accessing an infant residing in the sleeping cavity 130. Removable panels 132 may be found in different configurations between different embodiments.

According to one embodiment, the disposable infant co-sleeper system 100 may be arranged as a kit. In particular, the disposable infant co-sleeper system 100 may further include a set of instructions. The instructions may detail functional relationships in relation to the structure of the disposable infant co-sleeper system 100 such that the disposable infant co-sleeper system 100 can be used, maintained, or the like, in a preferred manner. The kit may include all of the components of the present invention and multiples for use for example during a natural disaster so that they may be handed out for use.

Figure 2:
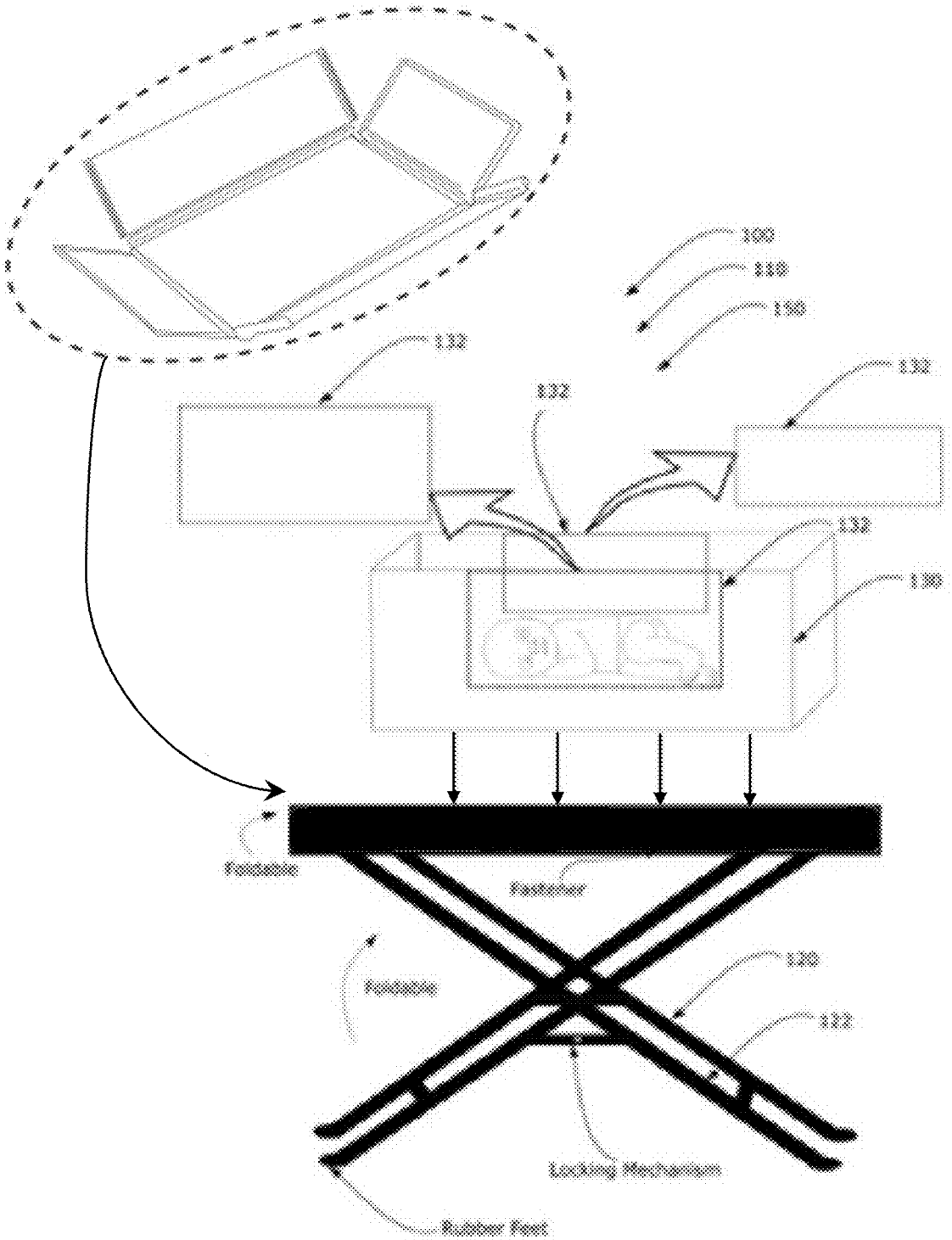
FIG. 2 is a perspective view of the disposable infant co-sleeper of FIG. 1, according to an embodiment of the present disclosure.
Figure 3:
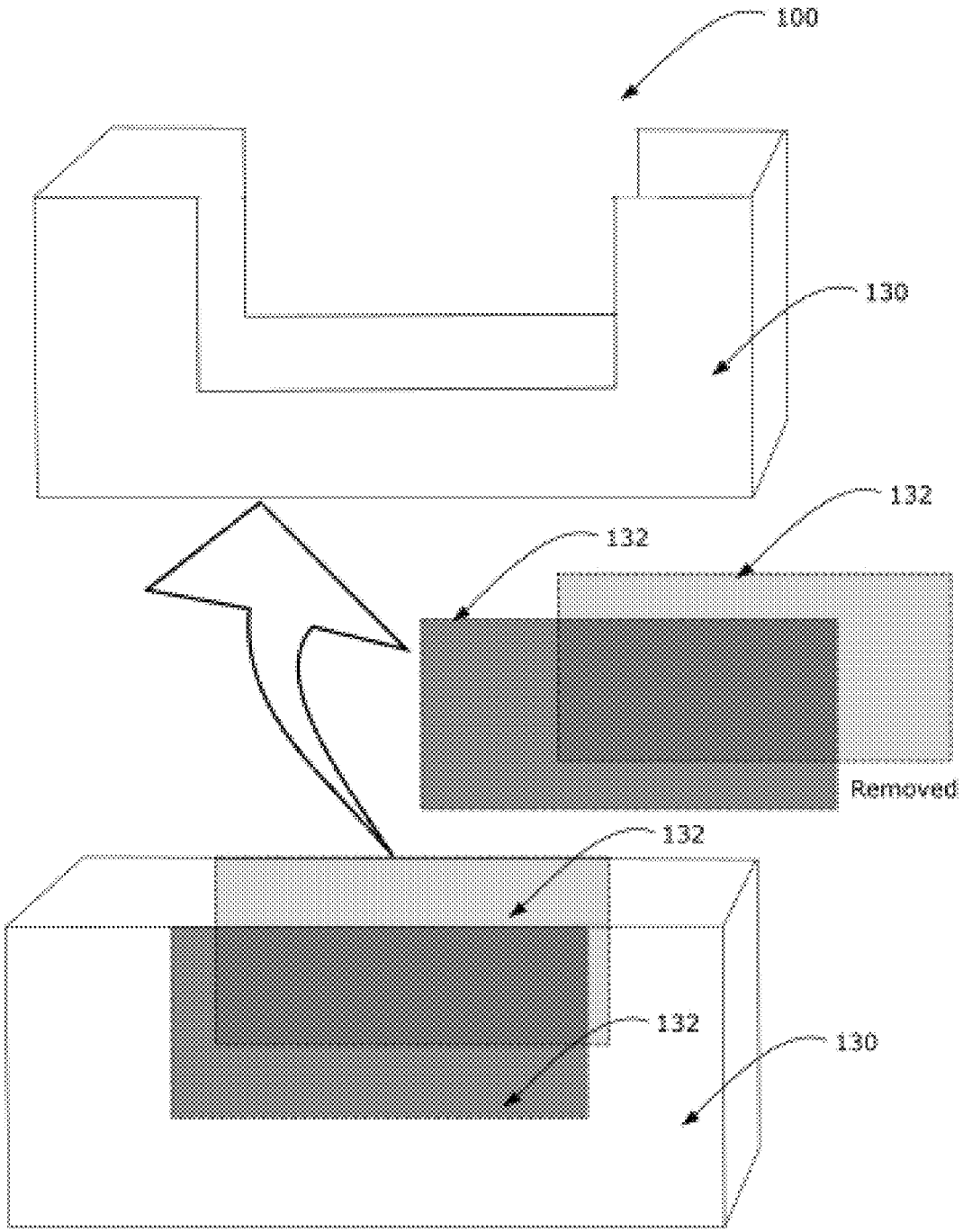
FIG. 3 is a perspective view of the disposable infant co-sleeper of FIG. 1, according to an embodiment of the present disclosure.
Figure 4:
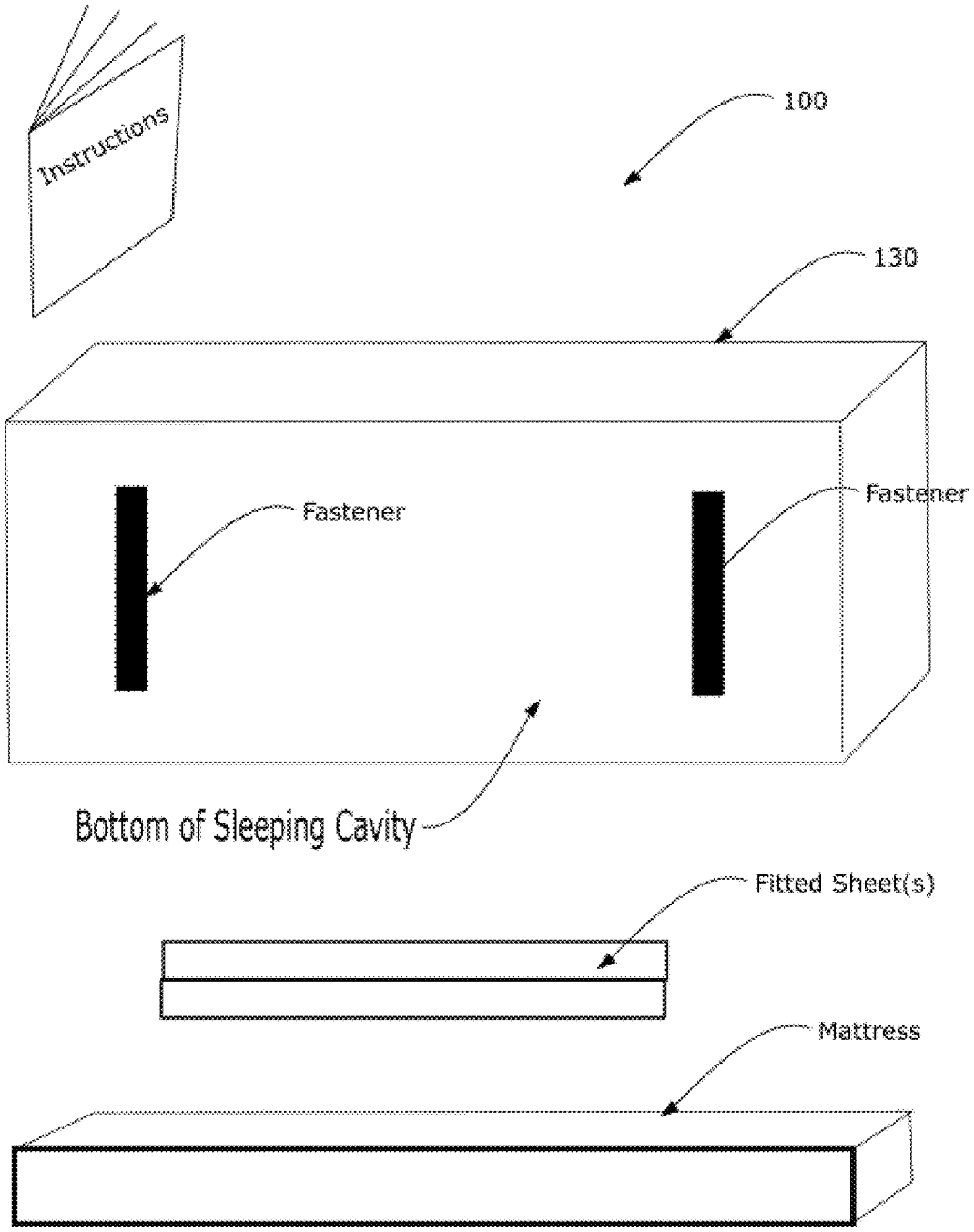
FIG. 4 is a perspective view of the disposable infant co-sleeper of FIG. 1, according to an embodiment of the present disclosure.

Referring now to FIGS. 2-4 showing various views of the disposable infant co-sleeper system 100 of FIG. 1, according to an embodiment of the present disclosure. As above, the disposable infant co-sleeper system 100 may include removable panels 132 which are able to be punched out of the sleeping cavity 130. The top of the stand 120 is preferably 20 inches above the planar surface during use. Certain embodiments may or may not be adjustable and have locking means or the like. The removable panels 132 are preferably located in sides of the cavity 130; wherein the cavity 130 has an open-top, as shown. The cavity 130 comprises a first-wall, a second-wall, a third-wall, a fourth-wall and a bottom-wall formed as an 'open box'. The removable panels 132 of the disposable infant co-sleeper system 100 are perforated (or otherwise scored) and as such are able to be 'punched out' of the sleeping cavity 130 when desired. In preferred embodiments sleeping cavity 130 comprises appropriate fastening means for attaching a mosquito net thereto above the open-top. The disposable infant co-sleeper assembly 110 may further comprise a mattress 134 and a fitted sheet for comfort of the infant. The stand 120 preferably has a permanent flat top with side extensions that fold up in place to create a base that the sleeping box (sleeping cavity 130) fits in. The height on those sides is equal to the lip left over when the side perforations (removable panels 132) are removed. With that in mind, the mattress height should be such that the baby is positioned below the edge of the lip, not 'even' with it, so the baby can't roll or slide out.

Referring now back to the stand 120; the stand 120 preferably comprises foldable legs 122; wherein the foldable legs 122 allow the stand 120 to collapse during a non-use condition. Alternate embodiments may comprise other forms of legs such as telescopic or the like. The disposable infant co-sleeper system 100 comprises foldable legs 122 comprising a scissored-configuration (shown) since they can be easily stacked and stored and are cost-effective to produce. Cross-beams are shown such that legs 122 can be locked in position and the device is stable. The foldable legs 122 may be beveled to push into the planar surface (such as soft or uneven ground) when the planar surface does not comprise a floor. Certain embodiments having non-beveled legs may have end caps on the foldable legs 122 or rubber-tipped legs so as to reduce relative movement on level surfaces such as gymnasium floors. Other gripping means may be employed. The foldable legs 122 are preferably made of corrosion resistant and durable material for safety in use and longevity.

Figure 5:
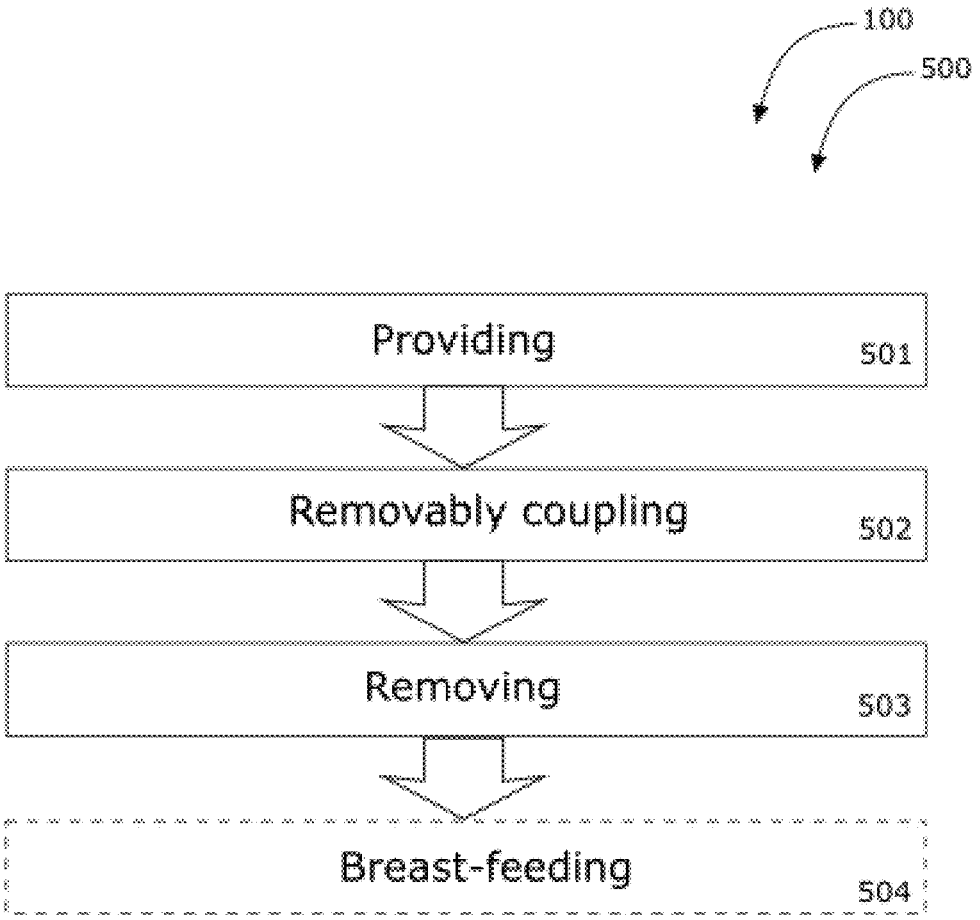
FIG. 5 is a flow diagram illustrating a method of use for the disposable infant co-sleeper, according to an embodiment of the present disclosure.

FIG. 5 is a flow diagram illustrating a method of use 500 for the disposable infant co-sleeper system 100, according to an embodiment of the present disclosure. In particular, the method of use 500 for the disposable infant co-sleeper system 100 may include one or more components or features of the disposable infant co-sleeper system 100 as described above. As illustrated, the method for using 500 the disposable infant co-sleeper system 100 may include the steps of: step one 501, providing a disposable infant co-sleeper assembly (as disclosed), step two 502 removably coupling a sleeping cavity to a stand, and step three 503 removing removable panels (as user-determined) to access an infant residing in the sleeping cavity. The method 500 may further comprise the step four 504 of: breast-feeding or otherwise consoling the infant at a comfortable height.

It should be noted that step 504 is an optional step and may not be implemented in all cases. Optional steps of method of use 500 are illustrated using dotted lines in FIG. 5 so as to distinguish them from the other steps of method of use 500. It should also be noted that the steps described in the method of use can be carried out in many different orders according to user preference. The use of "step of" should not be interpreted as "step for", in the claims herein and is not intended to invoke the provisions of 35 U.S.C. § 112(f). It should also be noted that, under appropriate circumstances, considering such issues as design preference, user preferences, marketing preferences, cost, structural requirements, available materials, technological advances, etc., other methods for use and manufacture/shipping are taught herein.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A disposable infant co-sleeper system comprising:

a disposable infant co-sleeper assembly including a stand; and a sleeping cavity; whereby said stand is constructed with a flat top and with side extensions that fold up in place to create a base defining said sleeping cavity;

removable panels constructed and arranged such that a horizontal lip is defined after said panels are removed, said lip is for side access to said sleeping cavity; and a mattress having a mattress height below said lip;

wherein said disposable infant co-sleeper system comprises said disposable infant co-sleeper assembly;

wherein said disposable infant co-sleeper assembly comprises in functional combination said stand and said sleeping cavity;

wherein said sleeping cavity is removably fastenable to said stand, such that said sleeping cavity is erected such that it is raised above and located on a plane above a planar surface;

wherein said removable panels are able to be punched out of said sleeping cavity;

wherein said removable panels are perforated and as such are able to be punched out of said sleeping cavity when desired;

wherein a top of said stand is 20 inches above said planar surface;

wherein said removable panels are located in sides of said sleeping cavity;

wherein the sleeping cavity has an open-top;

wherein the sleeping cavity comprises a first-wall; a second-wall; a third-wall; a fourth-wall and a bottom-wall;

wherein said first-wall and said third-wall comprise said sides;

wherein the sleeping cavity comprises means for attaching a mosquito net thereto above said open-top;

wherein the sleeping cavity further comprises attaching means for attaching said cavity to said stand;

wherein the disposable infant co-sleeper assembly further comprises a mattress;

wherein the disposable infant co-sleeper assembly further comprises a fitted sheet;

wherein the stand comprises foldable legs;

wherein the foldable legs allow said stand to collapse during a non-use condition;

wherein the foldable legs comprise a scissored-configuration and can be locked;

wherein sides of a base are able to be folded up into place;

wherein the foldable legs are made of corrosion resistant material; and wherein said sleeping cavity comprises cardboard and has said removable panels for ease of accessing an infant residing in said sleeping cavity.

2. The disposable infant co-sleeper system of claim 1, further comprising set of instructions; and wherein the disposable infant co-sleeper system is arranged as a kit.

* * * * *